United States Patent [19]

Joachim et al.

[11] Patent Number: 5,067,461

[45] Date of Patent: Nov. 26, 1991

[54] METHOD AND APPARATUS FOR METERING FUEL IN A DIESEL ENGINE

[75] Inventors: Ernst-Ulrich Joachim, Glücksburg; Hermann Kull, Stuttgart, both of Fed. Rep. of Germany

[73] Assignee: Robert Bosch GmbH, Stuttgart, Fed. Rep. of Germany

[21] Appl. No.: 490,668

[22] PCT Filed: Jul. 28, 1988

[86] PCT No.: PCT/DE88/00467

§ 371 Date: Mar. 5, 1990

§ 102(e) Date: Mar. 5, 1990

[87] PCT Pub. No.: WO89/02524

PCT Pub. Date: Mar. 23, 1989

[30] Foreign Application Priority Data

Sep. 5, 1987 [DE] Fed. Rep. of Germany ..... 3729771

[51] Int. Cl.[5] ..... F02D 31/00

[52] U.S. Cl. ..... 123/357; 123/358; 123/479

[58] Field of Search ..... 123/357, 358, 359, 479

[56] References Cited

U.S. PATENT DOCUMENTS

| | | | |
|---|---|---|---|
| 4,223,654 | 9/1980 | Wessel | 123/358 |
| 4,359,991 | 11/1982 | Stumpp et al. . | |
| 4,476,829 | 10/1984 | Straubel | 123/357 |
| 4,548,177 | 10/1985 | Best | 123/357 |
| 4,566,414 | 1/1986 | Sieber | 123/359 |
| 4,589,392 | 5/1986 | Wirz | 123/357 |
| 4,709,335 | 11/1987 | Okamoto | 123/357 |
| 4,730,586 | 3/1988 | Yamaguchi | 123/357 |
| 4,836,166 | 6/1989 | Wietelmann | 123/358 |
| 4,881,404 | 11/1989 | Siegl | 123/357 |

FOREIGN PATENT DOCUMENTS

| | | | |
|---|---|---|---|
| 0065524 | 4/1984 | Japan | 123/357 |
| 0211730 | 11/1984 | Japan | 123/357 |

*Primary Examiner*—Carl Stuart Miller

*Attorney, Agent, or Firm*—Walter Ottesen

[57] ABSTRACT

A method and an apparatus for metering fuel in a diesel engine is suggested wherein the fuel quantity is taken from a multi-dimensional characteristic field in the part-load range, in the full-load range, however, a limitation of the fuel quantity is undertaken with the aid of a lambda control. Minimal value selection stages are used for decoupling the various methods of fuel quantity control. Notwithstanding the dead times present in the system, there results a dynamically satisfying lambda control system since up to a catch curve, a rapid control and thereafter a slower lambda control are used. The use of a lambda control for full-load limiting leads to an exhaust gas almost completely free of particles.

10 Claims, 3 Drawing Sheets

METHOD AND APPARATUS FOR METERING FUEL IN A DIESEL ENGINE

FIELD OF THE INVENTION

The invention is based on a method and apparatus for metering fuel to a diesel engine. The fuel quantity required for the particular operating condition of a diesel engine is generally determined in dependence upon the rotational speed of the engine and from the accelerator pedal position (also in dependence upon other variables as required). Since driving is done with an excess of air, the quantity of the fresh air drawn in by suction is of only subordinate significance. Requirements for a reduction of contaminant exhaust gases and a possible reduction of exhaust particles in internal combustion engines lead, however, to the consequence that the quantity of the fresh air drawn in by suction in diesel engines is also considered in the determination of the fuel quantity.

BACKGROUND OF THE INVENTION

A method and an apparatus are known from DE-OS 28 03 750 wherein the fresh air quantity drawn in by suction is considered in the determination of the fuel quantity. Air quantity and fuel quantity are precontrolled starting with the accelerator pedal position which signals a desire for a quantity of fuel. Thereafter, the exact values are taken from multi-dimensional characteristic fields. Air quantity and fuel quantity are then controlled to these precise values. The fuel quantity is limited by limitations stored in the characteristic fields. The ratio of air to fuel (lambda) influences these limitations especially with respect to the particle exhaust. Corresponding lambda values are stored in the characteristic fields.

It has been shown that with aging of the engine, deviations between the data stored in the characteristic fields and the actual conditions of the engine occur. As a consequence of such a deviation, an increased exhaust of particles during full-load operation can often occur.

Furthermore, a control arrangement for a fuel metering system of an internal combustion engine is known from DE-OS 30 39 436. With the arrangement described here, a PI-controller determines the quantity of fuel to be injected into the engine in dependence upon the comparison between the desired lambda value and the actual lambda value. The PI-constants of the controller are stored in a characteristic field in dependence upon load and rotational speed. The controller is preferably switched out during the full-load condition.

SUMMARY OF THE INVENTION

It is an object of the invention to provide a method and apparatus with which the increased particle exhaust caused by aging is avoided with the lambda control being only active when it is necessary.

The method with the features of the main claim has the advantage with respect to the state of the art that the actual lambda value is measured directly and is applied during full-load operation for controlling the highest permissible quantity of fuel. A further advantage is seen in the simple technique of the replacement of conventional lambda control of the fuel quantity by a minimum value selection. The influence of system-conditioned dead times is avoided by a rapid control to an effective "catch curve" and a subsequent slow lambda control.

Further advantages and configurations of the invention become evident from the measures provided in the dependent claims.

BRIEF DESCRIPTION OF THE DRAWINGS

An embodiment of the invention is shown in the drawing and is more carefully described in the description which follows.

DESCRIPTION OF THE PREFERRED EMBODIMENTS OF THE INVENTION

Figure 1:
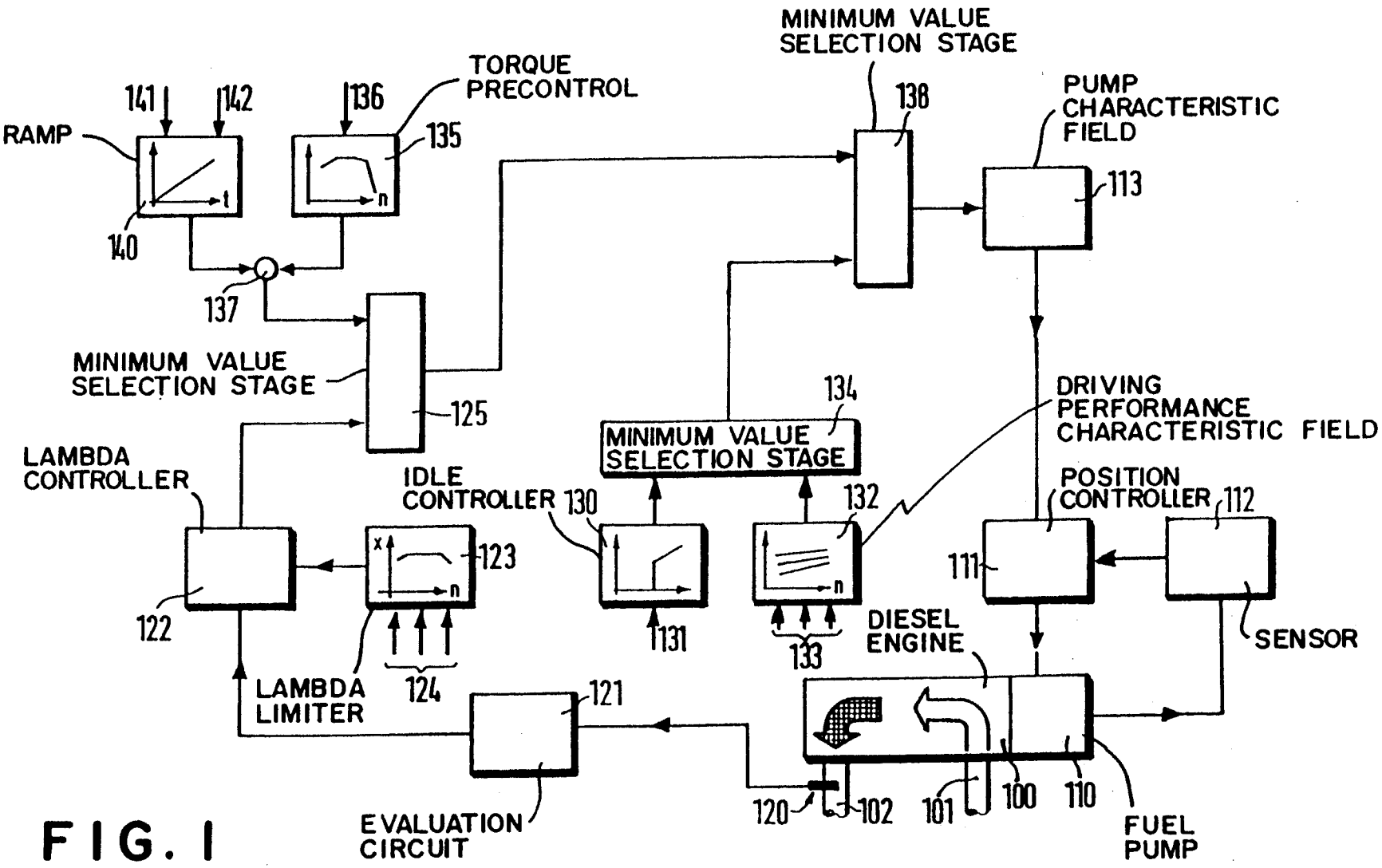
FIG. 1 shows a block circuit diagram wherein the essential elements for fuel quantity open-loop control and fuel quantity closed-loop control are contained.

In FIG. 1, 100 identifies a diesel engine. Fresh air is supplied to this engine via an intake pipe identified by 101. The exhaust gases are conducted away via the exhaust conduit 102. 110 identifies a fuel pump. The fuel pump is connected with a position controller 111. A sensor is identified by 112 and measures either the control path of a control rod mounted on the pump 110 or the closure time of a magnetic valve. The output signal of the sensor 112 is supplied to the summation point in 111. The output signal of the pump characteristic field identified by 113 is a further input signal of the position controller 111. 120 identifies a lambda probe mounted in the exhaust gas conduit of the engine. The output signal of the lambda probe is supplied to an evaluation circuit 121 having an output signal which is supplied to a lambda controller 122 as an actual value. The desired value is taken from a lambda limiter identified by 123 and which is dependent on several operating characteristic values identified by 124. Minimal value selection stages are identified by 125, 134 and 138. 130 identifies an idle controller which is driven by a signal identified by 131. 132 relates to a driving performance characteristic field wherein the fuel quantity to be metered to the engine is determined in dependence upon input quantities 133. 140 identifies a block which outputs a ramp-shaped output signal after initialization by a signal 142. The slope of the ramp is dependent upon the speed of the engine via 141. The output signal of the block 140 is supplied to a summation point 137 to which the output signal of a torque precontrol identified by reference numeral 135 is supplied as a further variable. The torque precontrol is dependent on the rotational speed of the engine via 136.

The described apparatus functions as follows: in the operating conditions start, idle and partial load, the fuel quantity to be metered to the engine is uninfluenced by the lambda control. Dependent upon the operating condition, a quantity of fuel is supplied to the internal combustion engine which is determined either from the idle controller 130, the torque precontrol 135 or the driving performance characteristic field 132. Which possible quantity of fuel is finally metered to the engine depends upon the minimum value selection stages 125, 134 and 138. The output signal of minimum value selection 138 is supplied to a pump characteristic field 113. In the pump characteristic field, a drive signal, which is dependent on operating parameters, for the position controller 111 is assigned to the fuel quantity signal. The position controller 111 controls to the fuel quantity which corresponds to the signal of the pump characteristic field 113. The elements pump 110, sensor 112 and position controller 111 then form a closed control loop. The operating conditions considered up until now preclude the lambda control from becoming effective since the output signal of the lamba controller 122 is, in the part-load range, always greater than the output signal of the torque precontrol 135. The full-load limitation with the aid of the lambda control is explained with reference to FIGS. 2 and 3.

Figure 2:
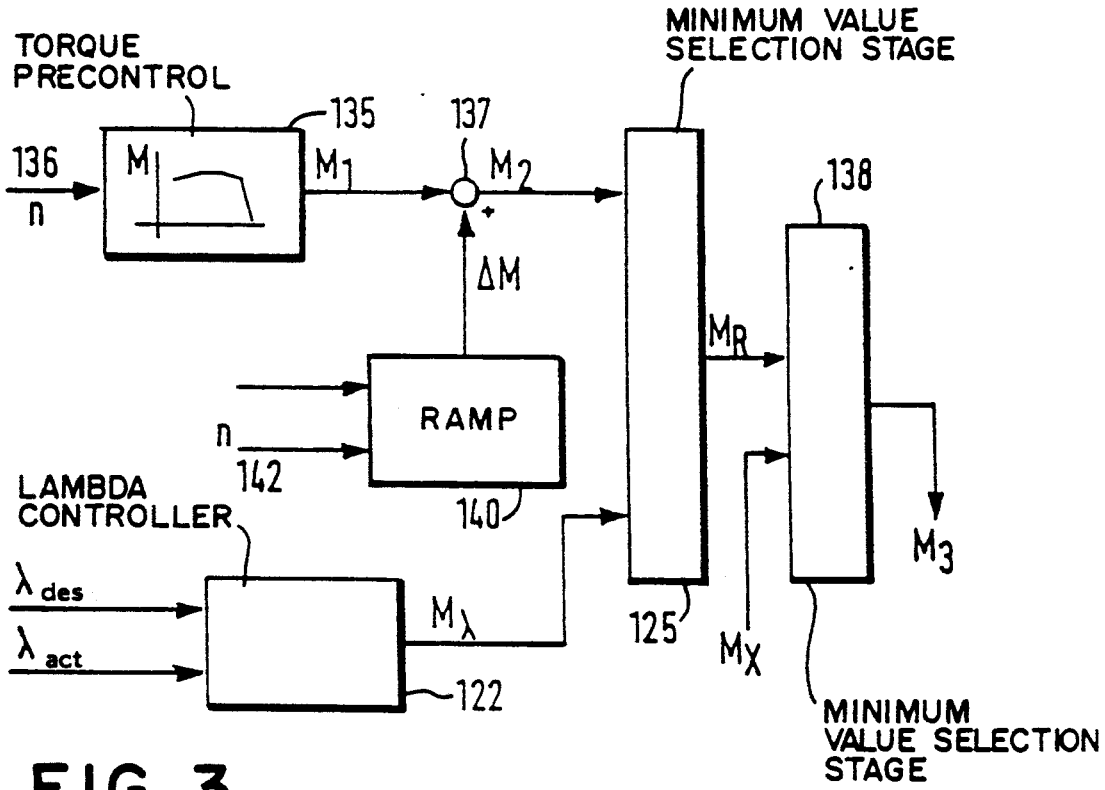
in FIG. 2, the essential elements are shown which are required for controlling the highest permissible fuel quantity.
Figure 3:
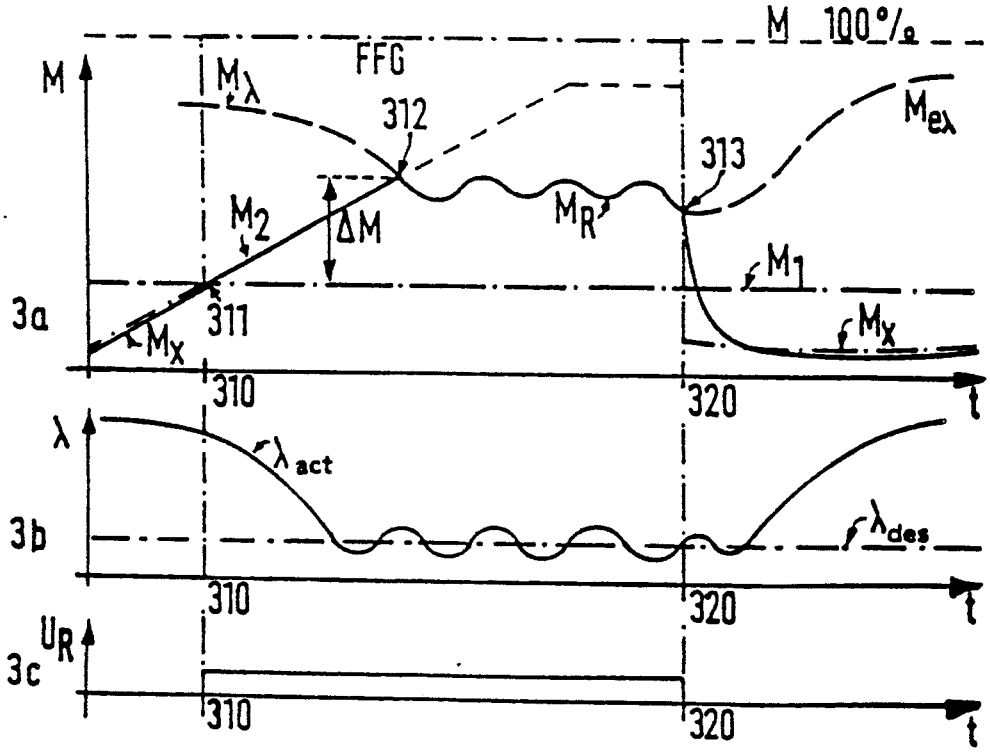
FIG. 3*a* shows the time course of different fuel quantity signals.
FIG. 3*b* shows the time course of the lambda probe signal.
FIG. 3*c* shows the time course of the start signal for the ramp.

FIG. 2 shows a block circuit diagram wherein only the elements are contained which are required for the lambda control. The same reference numerals identify the same elements. The torque precontrol 135 emits a fuel quantity signal identified by $M_1$. The ramp 140 always emits an additional signal identified by $\Delta M$ when the ramp is switched in. At point 137, the signals $M_1$ and $\Delta M$ are conjointly provide the signal $M_2$. The two signals $M_2$ and $M_{lambda}$ and are applied to the minimal value selection 125. Since $M_{lambda}$ is greater than $M_2$ in the part-load range, the signal $M_2$ reaches the output of the minimal selection 125. This signal is identified by $M_R$. Signals $M_R$ and $M_x$ reach the minimum value selection 138 having an output at which the signal $M_3$ is available. $M_x$ is the output signal of the minimum value selection 134 and originates either from the idle controller 131 or the driving performance characteristic field 132. Basically, the minimum value selectors 125 and 138 could be combined, but is shown with greater clarity in the drawing.

FIG. 3*a* shows the time course of the signals $M_1$, $M_2$, $M_{lambda}$, $M_4$, $M_x$ and $\Delta M$. In the lower diagram 3*b*, the time courses of the lambda actual value and of the lambda desired value are shown. In diagram 3*c*, the time range is shown in which the ramp is activated and generates the additional signal $\Delta M$.

The solid line in FIG. 3*a* identifies the fuel quantity signal $M_3$. Up to the time point 310, the fuel quantity $M_3$ is determined by $M_x$ since the relationship $M_x < M_1 < M_{lambda}$ applies. At the time 310, the vehicle should be accelerated which would be signalized by actuation of the accelerator transducer. The fuel quantity $M_x$ (dot-dash line) taken from the driving performance characteristic field 132 now increases to the maximum possible quantity. For times after the time point 310, the following applies:

$$M_R < M_x$$
and
$$M_1 < M_{lambda} < M_x$$
and
$$M_2 = M_1 + \Delta M(t)$$

With the presence of the last-mentioned condition, the ramp is activated from block 40 with the additional signal $\Delta M$. At the time point 311, the fuel quantity $M_3$ is equal to the fuel quantity $M_1$. After time point 310, the fuel quantity $\Delta M$ is added to the fuel quantity $M_1$ starting at zero. With the increase in fuel, the lambda actual value (see FIG. 3*b*) drops. At point 312, the signals $M_2$ and $M_{lambda}$ are equal. From this point on, the full-load limiting is undertaken with the aid of the lambda control. The following applies: $M_3 = M_R = M_{lambda}$. FIG. 3*b* shows that the lambda actual value is now equal to the lambda desired value.

At time point 320, the driver pulls back on the accelerator pedal. The dash-dotted line which shows the quantity $M_x$ drops below the value $M_1$. The minimum selection 138 causes the quantity $M_3$ metered to the engine to be equal to the quantity $M_x$. In this way, the fuel supply is decoupled from the lambda control and is taken over in the usual manner. It should be mentioned that at the time point 320, the start condition for the ramp 140 no longer applies and thereby an additional quantity $\Delta M$ is reduced.

Figure 4:
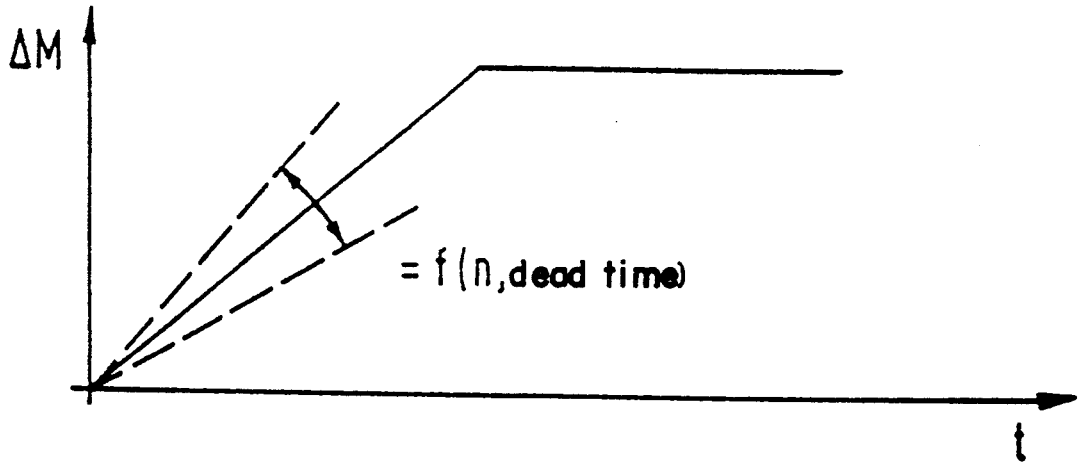
FIG. 4 illustrates the dependence of the ramp slope on the rotational speed of the engine.

With the minimum value selectors 125, 134 and 138, a very simple release mechanism has been found for the various control signals influencing the fuel quantity. Notwithstanding the specific dead times occurring in the control loop (charging dead times in the engine), the present method leads to no significant loss in dynamic. This is effected in that the slope of the ramp, on the one hand, is dependent on rotational speed and, on the other hand, is dependent from the specific dead times. This subject matter is shown by FIG. 4. There, the additional quantity $\Delta M$ is shown in dependence on time. The dependence of the other parameters is shown dotted.

Block circuit diagrams were selected to describe the embodiment since the method can be well illustrated with block circuit diagrams. The same method steps can however be subprograms of a program stored in a microcomputer. It is within the judgement of the person of skill to use the solution corresponding to the state of the art.

We claim:

1. A method of metering fuel to a diesel engine operable at part load and full load, the engine having a controller for supplying a quantity of fuel to the engine via a fuel pump, the method comprising the steps of:

utilizing a lambda probe arranged in the exhaust gas flow of the engine to measure the actual value of lambda which is indicative of the ratio of air and fuel supplied to the engine;

providing a desired value of lambda in dependence upon at least the engine speed;

open-loop controlling the fuel quantity metered to the engine during the part-load operation in dependence upon at least the engine speed and accelerator pedal position;

comparing the desired value of lambda with the actual value of lambda;

transferring from the open-loop control to closed-loop control when the engine passes from part-load operation to full-load operation by utilizing the controller to control the actual value of lambda to the desired value of lambda by controlling the quantity of fuel metered to the engine in dependence upon the comparison of said actual and desired lambda values;

detecting the full-load when the fuel quantity value taken from the characteristic field is greater than the precontrol value dependent upon torque; and, at full-load, adding a time variable additional signal to the fuel quantity signal dependent upon torque.

2. The method of claim 1, wherein the additional signal increases linearly with time.

3. The method of claim 2, wherein the slope of the ramp is dependent upon the rotational speed of the engine.

4. The method of claim 3, wherein the slope of the ramp is dependent upon the dead time of the lambda control.

5. An apparatus for metering fuel to a diesel engine, the engine having a controller and a fuel pump for supplying a quantity of fuel to the engine via a fuel pump, the engine further having an exhaust pipe, the apparatus comprising:

a plurality of sensors for detecting operating characteristic variables of the engine;

a control arrangement for generating a fuel quantity signal in dependence upon said operating characteristic variables and the operating condition of the engine;

a position controller for receiving said fuel quantity signal;

said position controller being operatively connected to said fuel pump for influencing said fuel pump in response to said fuel quantity signal;

means for providing a desired value of lambda in dependence upon at least the rotational speed of the engine;

a lambda probe mounted in the exhaust pipe for providing a lambda signal indicative of the actual value of lambda;

first control means for open-loop controlling said fuel-quantity signal to control the fuel quantity metered to the engine in dependence upon the operating characteristic variables of rotational speed and accelerator pedal position when the engine operates in a load range outside of full-load operation; and, second control means for substituting the open-loop control of said fuel quantity for a closed-loop control thereof during the full-load operation of the engine by comparing said lambda values to each other and controlling said actual value of lambda to said desired value of lambda.

6. A method of metering fuel to a diesel engine operable at part load and full load, the engine having a controller for supplying a quantity of fuel to the engine via a fuel pump, the method comprising the steps of:

utilizing a lambda probe arranged in the exhaust gas flow of the engine to measure the actual value of lambda which is indicative of the ratio of air and fuel supplied to the engine;

providing a desired value of lambda in dependence upon at least the engine speed;

open-loop controlling the fuel quantity metered to the engine during the part-load operation in dependence upon at least the engine speed and accelerator pedal position;

comparing the desired value of lambda with the actual value of lambda; and, transferring from the open-loop control to closed-loop control when the engine passes from part-load operation to full-load operation by utilizing the controller to control the actual value of lambda to the desired value of lambda by controlling the quantity of fuel metered to the engine in dependence upon the comparison of said actual and desired lambda values.

7. The method of claim 6, wherein the transfer from part-load to full-load operation takes place by means of a minimum value selection.

8. The method of claim 6, wherein the fuel quantity to be metered to the engine is taken from characteristic fields.

9. The method of claim 6, wherein the fuel quantity is precontrolled in dependence upon desired speed of the engine.

10. The method of claim 6, wherein the full-load is detected when the fuel quantity value taken from the characteristic field is greater than the precontrol value dependent upon torque.

* * * * *

UNITED STATES PATENT AND TRADEMARK OFFICE

CERTIFICATE OF CORRECTION

PATENT NO. : 5,067,461

DATED : November 26, 1991

INVENTOR(S) : Ernst-Ulrich Joachim and Hermann Kull

It is certified that error appears in the above-identified patent and that said Letters Patent is hereby corrected as shown below:

In column 3, line 24, between "are" and "conjointly", insert -- added and --.

In column 3, line 37: delete "$M_4$" and substitute -- $M_R$ -- therefor.

In column 3, lines 45 and 46: delete "$M_x < M-_1 < M_{lambda}$" substitute -- $M_x < M_1 < M_{lambda}$ -- therefor.

Signed and Sealed this

Twenty-seventh Day of April, 1993

*Attest:*

MICHAEL K. KIRK

*Attesting Officer*

*Acting Commissioner of Patents and Trademarks*